US007936230B2

(12) United States Patent
Pietig et al.

(10) Patent No.: US 7,936,230 B2
(45) **Date of Patent: *May 3, 2011**

(54) NON-RECIPROCAL COMPONENT AND METHOD FOR MAKING AND USING THE COMPONENT IN A MOBILE TERMINAL

(75) Inventors: Rainer Pietig, Herzogenrath (DE); Meng Cao, Xi'an (CN)

(73) Assignee: ST-Ericsson SA, Plan-les-Ouates (CH)

( * ) Notice: Subject to any disclaimer, the term of this patent is extended or adjusted under 35 U.S.C. 154(b) by 0 days.

This patent is subject to a terminal disclaimer.

(21) Appl. No.: 12/498,730

(22) Filed: Jul. 7, 2009

(65) Prior Publication Data

US 2009/0275297 A1 Nov. 5, 2009

Related U.S. Application Data

(63) Continuation of application No. 11/658,229, filed as application No. PCT/IB2005/052294 on Jul. 11, 2005, now Pat. No. 7,570,128.

(30) Foreign Application Priority Data

Jul. 22, 2004 (EP) ..... 04300459

(51) Int. Cl.
*H01P 1/38* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS 4,313,095 A 1/1982 Jean-Frederic
7,570,128 B2 * 8/2009 Pietig et al. ..... 333/1.1
2002/0079981 A1 6/2002 Tanaka ..... 331/1.1
2002/0113682 A1 8/2002 Gevorgian et al. ..... 336/200
2004/0004521 A1 * 1/2004 Hasegawa ..... 333/24.2

FOREIGN PATENT DOCUMENTS

WO 2004/055936 7/2004

OTHER PUBLICATIONS

Cao, M., et al. "Perturbation Theory Approach to the Ferrite Coupled Stripline," IEEE MTT-S Digest, 2004, pp. 1903-1906.
Queck, C., et al. "Butterfly-shape Folding of a Ferrite Coupled Line," Proceedings of the 36th European Microwave Conference, Sep. 2006, pp. 1147-1150.
Queck, C., et al. "Novel Folding Technique for Planar Ferrite-Coupled-Line Circulators," IEEE Transactions on Microwave Theory and Techniques, May 2004, pp. 1369-1374, vol. 52, No. 5.
Mazur, J. et al., "Development of Ferrite Coupled Lines Gyrator," 14th International Conference on Microwaves, Radar and Wireless Communications, May 20-22, 2002, Piscataway, NJ, pp. 245-248.
Mazur, J. et al., "Ferrite Coupled Lines Junction and its Nonreciprocal Devices," 14th International Conference on Microwaves, Radar and Wireless Communications, May 20-22, 2002, Piscataway, NJ, pp. 233-236.

* cited by examiner

*Primary Examiner* — Stephen E Jones
(74) *Attorney, Agent, or Firm* — Thomas J. Satagaj; Seed IP Law Group PLLC

(57) ABSTRACT

The invention relates to a non-reciprocal component comprising: a ferrite substrate having a first side and an opposing second side located on a ground layer, a first metal line and a second metal line are located on the ferrite substrate in parallel to each other. To provide a non-reciprocal component having small dimensions and which could be integrated. The ferrite substrate is magnetized parallel to the metal lines and each of the metal lines is running at least from one side of the ferrite substrate to the other side and back forming thereby at least one meander loop, wherein the loops are interlaced to each other and the metal lines are isolated in an area of the loop.

19 Claims, 4 Drawing Sheets

NON-RECIPROCAL COMPONENT AND METHOD FOR MAKING AND USING THE COMPONENT IN A MOBILE TERMINAL

CROSS-REFERENCE TO RELATED APPLICATION

This application is a continuation that claims priority under 35 U.S.C. §120 to currently pending U.S. patent application Ser. No. 11/658,229, entitled "INTEGRATED NON-RECIPROCAL COMPONENT COMPRISING A FERRITE SUBSTRATE," filed Jan. 22, 2007, assigned to the same assignee as the present application, and incorporated herein by reference in its entirety.

BACKGROUND

1. Technical Field

The invention relates to a non-reciprocal component comprising a ferrite substrate having a first and an opposing second side located on a ground layer, wherein a first metal line and a second metal line are located on the ferrite substrate in parallel to each other. The invention relates further to an integrated circuit including a non-reciprocal component and to a circulator.

2. Description of the Related Art

Non-reciprocal components are used especially in microwave technology, which has become very important during the last years. Various frequency bands are used for commercial applications, e.g., GSM (~1 GHz), UMTS (~2 GHz), Bluetooth (~2.5 GHz), WLAN (~5 GHz) etc. There is a clear trend towards higher frequencies in order to obtain larger bandwidths and hence higher data rates. Moreover new microwave applications at higher frequencies like car radar (24 GHz or 77 GHz) have entered the market. In this sector, a large growth within the next few years is expected.

Non-reciprocal RF components like circulators and isolators have a wide range of applications. In many cases simple and robust system architectures can be used using such non-reciprocal RF components. The application of non-reciprocal RF components simplifies the design process of high frequency parts and saves cost. E.g., isolators are used in the RF front end of UMTS phones, since the required linearity of the receiver can be guaranteed in a simple way. In that case the isolator is connected between an antenna of a mobile terminal and an output power amplifier. So a signal coming from the output power amplifier is coupled into the isolator in port 1 and outputted at port 2 and directed to the antenna. The isolator insulates the power amplifier from a signal running back from the antenna to the power amplifier. The high cost of the isolator is accepted, since a modified system architecture which does not need an isolator would be very difficult to design and not reliable.

The high production costs of state of the art non-reciprocal RF components are due to their very complex internal set up. To generate the non-reciprocal effect, ferrite material is essentially needed. Apart from a ferrite material various metal electrodes or metallization layers are required to guide the microwave, wherein the microwave is guided between metallization layers. One or two permanent magnets are needed to magnetize the ferrite material. Moreover several pole pieces are needed to guide the magnetic field lines of the permanent magnet in order to generate a very homogeneous magnetic field in the region of the ferrite material. All parts of the non-reciprocal component have to be assembled during a complicated production process.

The integration of passive components like capacitors and inductors either into the substrate by using multilayer LTCC or multilayer laminates, etc. or directly on a semiconductor chip has become an industrial standard in order to miniaturize and reduce the costs of electronic circuits. Unfortunately, integrated solutions for non-reciprocal RF components are up to now not available.

Since the common design of the non-reciprocal RF components uses a magnetic field, which is directed perpendicular to the propagation direction of the microwave, it was not possible to integrate such components, particularly because the permanent magnets have to be placed below and/or above the ferrite material. This results in a large height of the component. Since the required permanent magnetic field increases with the working frequency, the height problems become particularly severe in the high frequency range. Moreover, the configuration using a perpendicular magnetic field leads to large demagnetization effects, which can be compensated only by using stronger and therefore bigger permanent magnets. At high working frequencies, this problem becomes more and more pronounced. Integration of such a design is therefore not feasible.

A better configuration with respect to integration of passive components would be realized if the direction of the magnetic field is parallel or in-plane to the ferrite substrate. This means the magnetic field lines are directed in a propagation direction of the microwave. However, non-reciprocal components, which utilize this in-plane magnetization, are not available.

The simplest design of this in-plane magnetization of the ferrite substrate may include two parallel striplines or microstrip lines, which are printed on a ferrite substrate. To achieve an acceptable non-reciprocal behavior of the components using in-plane magnetization of the ferrite substrate, a large length of the metal lines will be required. The required length of the metal lines would reduce the commercial value of the design.

BRIEF SUMMARY

Therefore it is an object of the present invention is to provide a non-reciprocal component having reasonable dimensions allowing an integration of non-reciprocal components.

The object of the present invention is solved by the features given in the independent claims.

The invention is based on the thought that by using in-plane magnetization of a ferrite substrate the height problem mentioned above will be solved. The proposed non-reciprocal component is based on a configuration using in-plane magnetization of the ferrite substrate. To reduce the required length and maintain the non-reciprocal behavior, it is further proposed to arrange metal lines in such a way that they are running at least one time from one side of the ferrite substrate to the opposite other side of the ferrite substrate and back. This course or track of the metal lines on the ferrite substrate will reduce the total length of the component. However the two metal lines have to be arranged interlaced on their track on the ferrite substrate. To achieve the required non-reciprocal behavior the first metal line and the second metal line are formed like meander loops, wherein the meander loops are interlaced. However the metal lines have to be isolated from each other especially in the area of the loop at the end of the ferrite substrate. By arranging both metal lines in that way a non-reciprocal behavior will be created. Both metal lines have two ports located at the ends of a metal line. By interlacing the meander loops, a 4-port circulator is provided. A 4 port circulator acts as a one way component allowing the microwave to pass only in one direction, e.g., from port 4 to port 1. The microwave will be damped in all other directions. The non-reciprocal component enables a considerable miniaturization compared to a component based on only two elongated metal lines arranged in parallel. In contrast to commercially available components of this type this non-reciprocal circuit element is perfectly suited for integration using multilayer technology (like e.g., LTCC). The employment of such a monolithic approach can reduce the production costs significantly.

Since in-plane magnetization is used the magnetic field strength to be applied needs to be very small in comparison to the common design with the perpendicular magnetic field. Using in-plane magnetization only small demagnetization effects will appear, so the magnetic field generated by the permanent magnets needs to be very small. This will further reduce the dimensions of the permanent magnets and therefore of the whole non-reciprocal component.

By providing the two metal lines in a plurality of meander loops, which are interlaced, the non-reciprocal behavior could be improved.

In a preferred embodiment of the present invention the ports of the metal lines could be located on both sides of the ferrite substrate. This may simplify the layout of the component in certain cases. Further, the flexibility in the arrangement of the ports in relation to the surrounding components is increased.

According to a preferred embodiment the metal lines could be realized as microstrip lines having a dielectric air layer over the metal lines. However the metal lines could be realized also as striplines having a ground layer below and above the striplines, wherein between the striplines and the upper ground layer a dielectric layer may be provided. The configuration depends on the application and the integration process used. If the non-reciprocal component is used in a LTCC component the striplines will be covered by a dielectric layer which is covered by a ground layer. If the non-reciprocal component is used in an integrated circuit, microstrip lines could be used, so the metal lines are covered by an air layer.

In a preferred embodiment of the present invention the magnetization effect of the ferrite substrate will be generated by arranging a hard ferrite substrate located below the ferrite substrate. The ferrite substrate having the metal lines attached is realized as a soft ferrite substrate using spinel substances or YIG (Yttrium Iron Garnet). The hard ferrite substrate is magnetized once with a predetermined magnetic field strength, wherein the magnet poles of the hard ferrite substrate are located on the first side and the opposing second side of the hard ferrite substrate. This hard ferrite substrate will create magnetic field lines running in parallel to the metal lines within the soft ferrite substrate. The material used for the hard ferrite substrate could be Barium-Hexaferrite.

The object of the present invention is also solved by an integrated circuit including a non-reciprocal component as described above.

The object of the present invention is also solved by a circulator realized as a non-reciprocal component as described above.

Preferred embodiments of the invention are described in detail below, by way of example only, with reference to the following schematic drawings.

The drawings are provided for illustrative purpose only and do not necessarily represent practical examples of the present invention to scale.

DETAILED DESCRIPTION

In the following, the various exemplary embodiments of the invention are described. Although the present invention is applicable in a broad variety of applications it will be described with the focus put on a 4 port circulator used in the area of microwave technology. A further field for applying the invention might be the use as isolator.

Figure 1A:
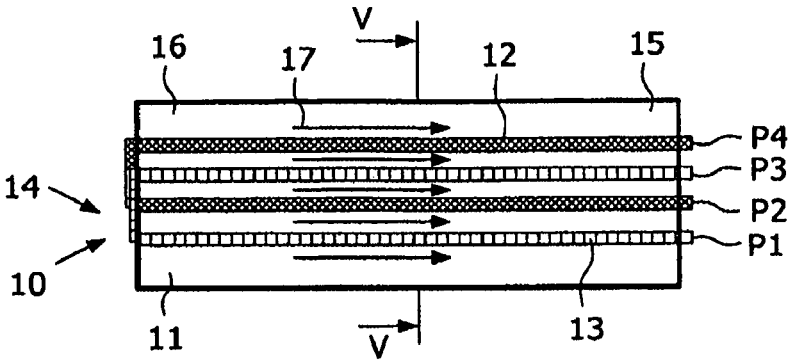
FIG. 1*a* illustrates a top view of a component according to the present invention.

FIG. 1*a* represents a top view of a non-reciprocal component 10, 4-port circulator embodiment according the present invention. A ferrite substrate 11 having a first side or end 15 and an opposing end 16. Two metal lines 12, 13 are printed on the ferrite substrate 11. The metal line 12 runs from side 15 to the opposing side 16 and back to side 15 just as metal line 13. Each metal line forms one meander loop. The meander loops of metal line 12 and of metal line 13 are interlaced to each other. Each metal line 12, 13 has two ports P1, P2, P3, P4. The first metal line 12 is connected to the ports P2 and P4. The second metal line 13 has the ports P1 and P3, each located at the end of the metal lines 12, 13.

Figure 1B:
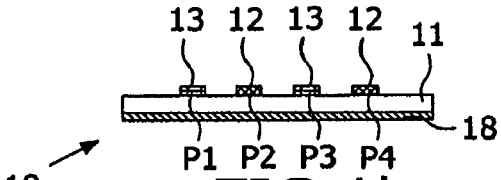
FIG. 1*b* shows a side view from the right end of a component according to FIG. 1.
Figure 1C:
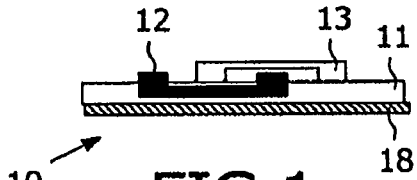
FIG. 1*c* shows the side view from the left end of a component according to FIG. 1.

The FIGS. 1*b* and 1*c* provide side views of the component illustrated in FIG. 1*a*. FIG. 1*b* shows the side 15 having the ports P1-P4. FIG. 1*c* shows the side 16 of the component having the looping area 14 of the metal lines 12 and 13. The ferrite substrate 11 is located on a ground layer 18 which is realized as a metallization layer. So a microwave (not shown) will be guided between the ground layer 18 and the metal lines 12 and 13 located on the ferrite substrate 11. As can be seen in FIG. 1*b* the metal lines 12 and 13 are interlaced to each other resulting in the alternating arrangement of the ports P1-P4. The looping area 14 is illustrated in FIG. 1*c*. The first metal line 12 is routed below the second metal line 13, whereas the second metal 13 is routed above the first metal line 12. Thus they are isolated to each other in the area 14 of the loop.

Figure 2A:
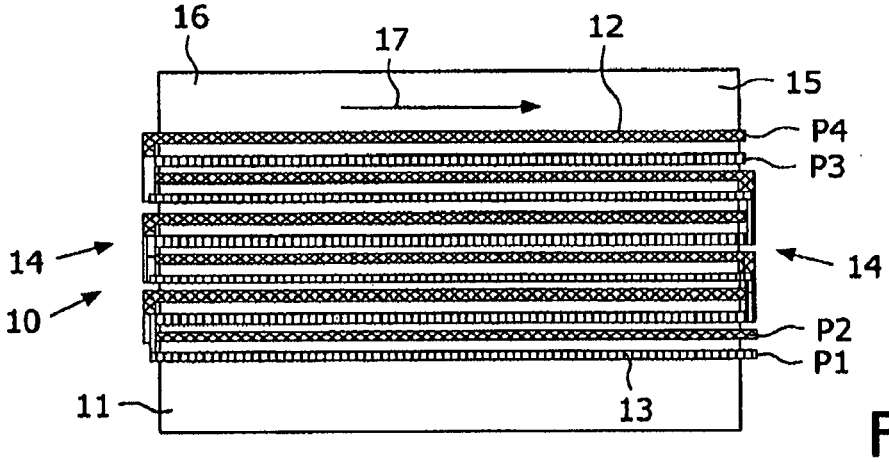
FIG. 2*a* illustrates a top view of a further embodiment of the present invention.
Figure 2B:
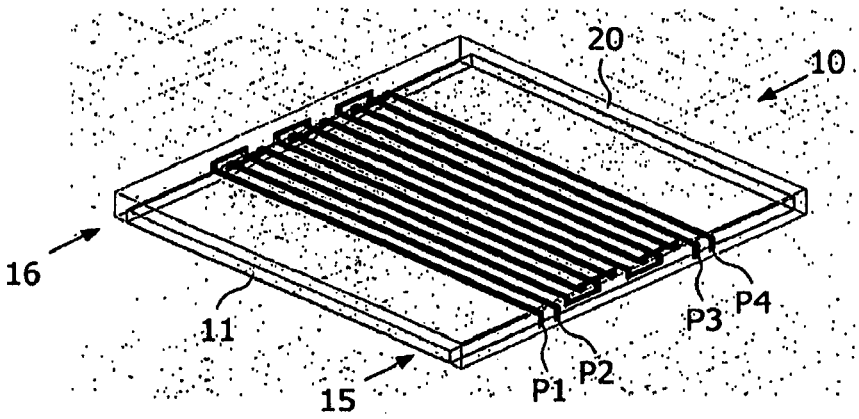
FIG. 2*b* illustrates a perspective view of the embodiment of FIG. 2*a;*

Referring to FIG. 2*a* a top view of an alternative embodiment of the inventive component is illustrated. This embodiment comprises a plurality of meander loops of the metal lines 12, 13. The meander loops are interlaced to each other. In the area of the loops located on both sides 15, 16 of the component the metal lines are isolated as illustrated in FIG. 1*c*. So a circulator is provided having 12 lines arranged in parallel forming interlaced meander loops. The non-reciprocal properties are improved in comparison to the component shown in FIGS. 1*a*-1*c*. A perspective view on the component of FIG. 2*a* is represented in FIG. 2*b*. In the shown embodiment of FIG. 2*b*, the ground layer 18 is omitted for clarity of the illustration; however, as mentioned above, the ferrite substrate 11 needs to be located on the not shown ground layer to guide the microwave between the ground layer and the metal lines. Above the metal lines 12 and 13, a dielectric layer 20 is provided having a thickness of 0.1 mm and a relative permittivity (dielectric constant) $\epsilon_r$ of 12. The arrangement of the ports P1-P4 is illustrated. In the embodiment, all ports P1-P4 are located on one side 15 of the component only, however it is also possible to arrange ports P1 and P2 on the opposing side 16. Finishing the metal lines 12 and 13 before the last track back to side 15 as shown in the FIG. 2*b* may accomplish a component having ports on opposing sides.

In an exemplary embodiment the metal lines will have a width of 0.045 mm and a distance to each other of 0.090 mm. The ferrite substrate 11 has a thickness of 0.100 mm, wherein the not illustrated ground layer 18 located below the ferrite substrate 11 has nearly the same thickness of 0.005 mm as the metal lines. These values will show only an example, wherein the man skilled in the art will recognize that different dimensions could be used. The embodiment of FIG. 2 has the lateral dimensions of 3 mm*5 mm. This points out the strong miniaturization which is possible by arranging the two metal lines 12, 13 like meander loops which are interlaced to each other.

Figure 3:
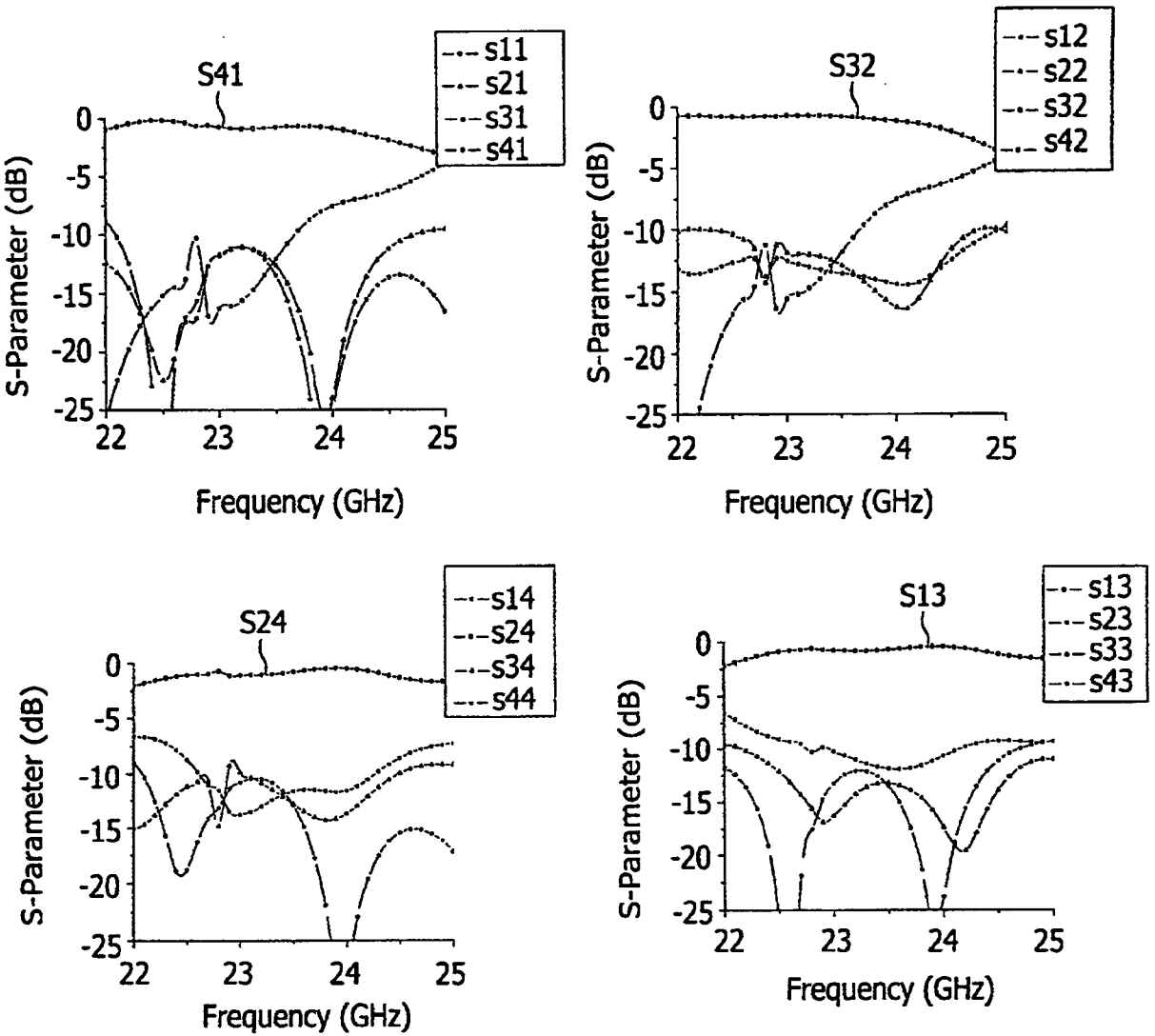
FIG. 3 illustrates the scattering parameters of the 4 port circulator according to the present invention.

FIG. 3 represents the scattering parameters of the 4-port circulator illustrated in FIGS. 2*a, b*. The scattering parameters are shown as function of the frequency in the area from 22 GHz-25 GHz. It can be derived clearly that the embodiment of FIGS. 2*a*, 2*b* provides the properties of a 4-port circulator. By adding matching networks the electrical performance with respect to bandwidth, insertion loss and isolation could be improved.

Figure 4:
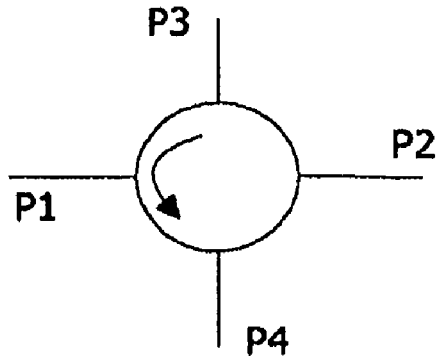
FIG. 4 shows a schematic illustration of a 4 port circulator.

As shown in FIG. 3 the scattering parameters S41, S32, S24 and S13 are close to 0 dB, which means that a signal or microwave directed from port P1 to port P4 will be nearly unaffected by the component. Also a microwave input in port P4 and guided to port 2 is nearly un-damped as can be seen by the scattering parameter S24, since the damping is nearly 0 db. Also, for directions from port P2 to port P3 and from port P3 to port P1, the microwave is not damped. The 4-port circulator having the scattering parameters shown in FIG. 3 is schematically illustrated in FIG. 4. The arrow will indicate the direction of the passage, wherein all other possible directions are blocked, e.g., from port P1 to port P2.

Figure 5A:
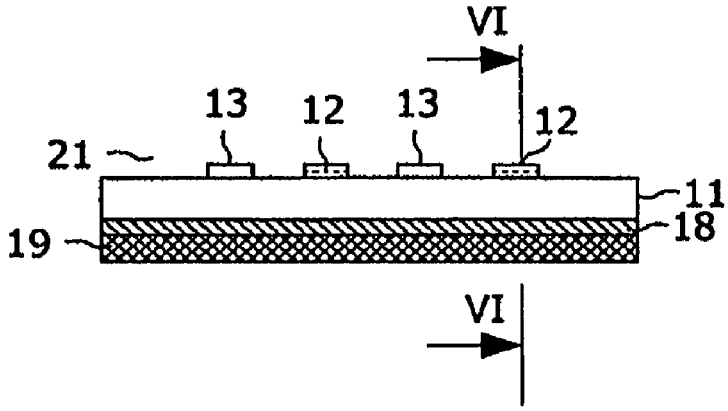
FIG. 5*a* illustrates a sectional view of an alternative embodiment along section lines V-V in FIG. 1.
Figure 5B:
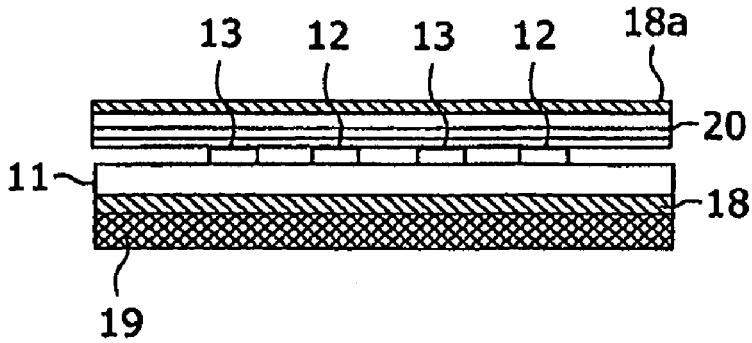
FIG. 5*b* illustrates a sectional view of a further alternative embodiment along section lines V-V in FIG. 1.

FIGS. 5*a* and 5*b* illustrate section views of a different embodiment based on the non-reciprocal component shown in FIG. 1. FIG. 5*a* represents a component having a hard ferrite substrate 19 located below the ground layer 18. The metal lines 12, 13 printed on the ferrite substrate 11 are embodied as microstrip lines. Microstrip lines provide a strong non-reciprocal coupling resulting in short length of the microstrip lines. Microstrip lines 12, 13 are used if an air layer 21 could be provided above the microstrip lines. The air layer 21 also has a dielectric property. The hard ferrite substrate 19 located below the ground layer 18 is magnetized once. Since the demagnetizing effects are very small, the magnetic field needs to be very small.

FIG. 5*b* illustrates a different embodiment. Here strip lines 12, 13 are used, which are covered by a dielectric layer 20 as shown in FIG. 2*b*. This embodiment also includes a hard ferrite substrate 19 located below the ground layer 18. Above the dielectric layer 20 a further ground layer 18*a* is located. The striplines provide a higher bandwidth in contrast to the microstrip lines, however they have a higher parasitic emission. Since the soft ferrite substrate 11 has a saturation magnetization of 3000 Gauss, the magnetic field for generating this maximal magnetization is provided by the hard ferrite substrate 19. The required magnetic field needs to be small only, e.g., a few mT.

Figure 6:
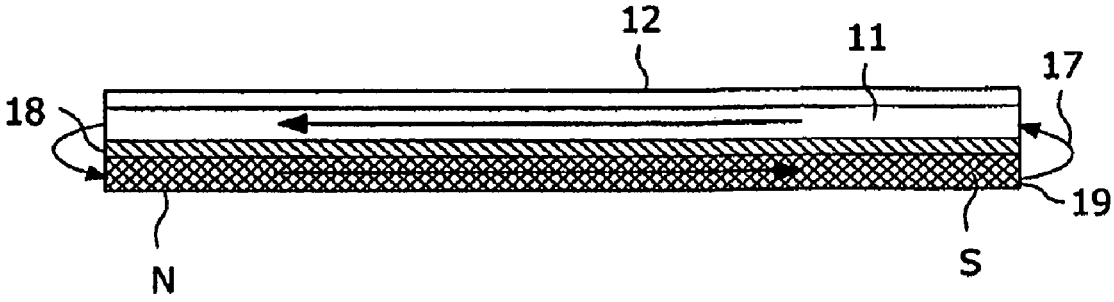
FIG. 6 illustrates a sectional view along section lines VI-VI in FIG. 5*a;*

FIG. 6 illustrates the run of the magnetic lines 17 generated by the magnetic hard ferrite substrate 19. The hard ferrite substrate 19 has two magnet poles N and S located on opposing sides of that hard ferrite substrate 19. By arranging a very thin, hard ferrite substrate 19, the required magnetic field could be realized very easily, thereby generating magnetic field lines running in parallel to the metal lines 12, 13 within the soft ferrite substrate 11. The magnetic field within the ferrite substrate 11 will cause the one way transmission effect of non-reciprocal components.

Figure 7:
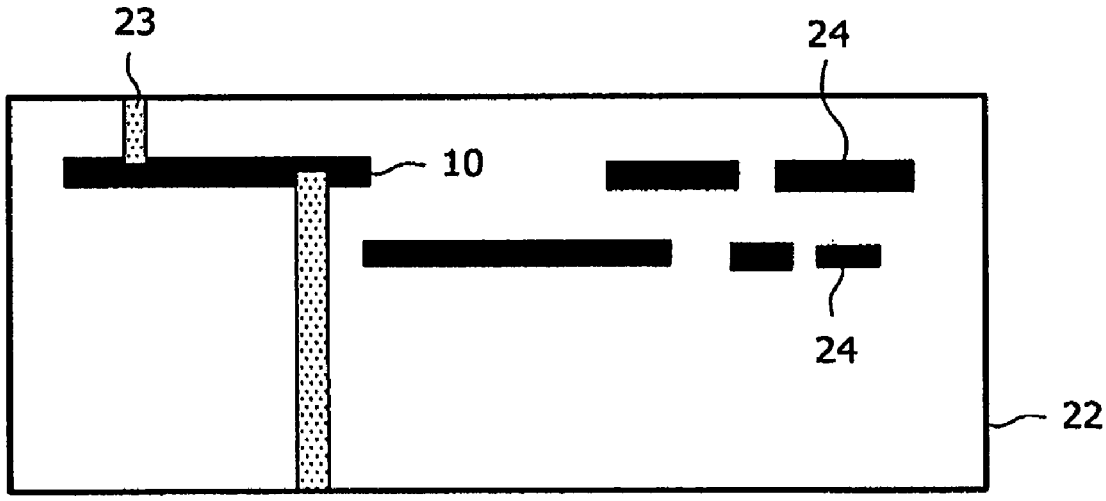
FIG. 7 shows a schematic illustration of integration of a non-reciprocal component into a LTCC component.

Thus, a non-reciprocal component will be provided having very small dimensions. The small dimensions allow an integration of the non-reciprocal component, e.g., in an LTCC component 22 as shown in FIG. 7, wherein the non-reciprocal component 10 is arranged within the LTCC component 22. There are further passive components 24 and vias 23 or connectors to connect the respective terminals of the incorporated components 10, 24.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A mobile device comprising:

a power amplifier;

an antenna; and a non-reciprocal component electrically coupled between the power amplifier and the antenna, the non-reciprocal component including:

a ferrite substrate having first and second sides, the ferrite substrate being magnetized in a direction extending between the first and second sides;

a first metal line and a second metal line formed on the ferrite substrate, the first and second metal lines forming first and second meander loops, respectively, by each extending from the first side to the second side and back, the first and second meander loops being interlaced with, and isolated from, one another, wherein the first metal line has first and second ports provided at first and second ends of the first metal line and the second metal line has first and second ports provided at first and second ends of the second metal line.

2. The mobile device according to claim 1 wherein the ports of the first and second metal lines are located at the first side of the ferrite substrate.

3. The mobile device according to claim 1 wherein the first ports of the first and second metal lines, respectively, are located at the first side of the ferrite substrate and the second ports of the first and second metal lines, respectively, are located at the second side of the ferrite substrate.

4. The mobile device according to claim 1 wherein the first and second metal lines are realized as microstrip lines having a dielectric air layer over the first and second metal lines.

5. The mobile device according to claim 1 wherein the first and second metal lines are realized as strip lines, the non-reciprocal component further including:

an upper ground layer over the strip lines; and a dielectric layer provided between the upper ground layer and the ferrite substrate.

6. The mobile device according to claim 1 wherein the ferrite substrate includes:

a hard ferrite substrate, the hard ferrite substrate having magnetic poles located on a first side and a second side of the hard ferrite substrate to form magnetic field lines running substantially parallel to the first and second metal lines; and a soft ferrite substrate, the soft ferrite substrate magnetized by the hard ferrite substrate, and the soft ferrite substrate located above the hard ferrite substrate.

7. The mobile device according to claim 1 wherein the non-reciprocal component is formed in a low temperature co-fired ceramic (LTCC) device.

8. A method to form an integrated non-reciprocal component, comprising:

forming a ferrite substrate;

arranging a plurality of interlaced meander loops of metal lines on the ferrite substrate; and magnetizing the ferrite substrate substantially parallel to the metal lines, wherein the non-reciprocal component is formed in a low temperature co-fired ceramic (LTCC) process.

9. The method to form an integrated non-reciprocal component according to claim 8 wherein the metal lines are formed as microstrip lines.

10. The method to form an integrated non-reciprocal component according to claim 8 wherein forming the ferrite substrate includes forming the ferrite substrate on a metallization layer of an integrated circuit.

11. The method to form an integrated non-reciprocal component according to claim 10 wherein forming the ferrite substrate on the metallization layer includes configuring the metallization layer as a ground layer.

12. The method to form an integrated non-reciprocal component according to claim 8 wherein the ferrite substrate is formed from a soft material.

13. The method to form an integrated non-reciprocal component according to claim 12 wherein the soft material is yttrium iron garnet (YIG) or a spinel substance.

14. The method to form an integrated non-reciprocal component according to claim 8 wherein magnetizing the ferrite substrate is effected with a second ferrite substrate provided below the ferrite substrate.

15. The method to form an integrated non-reciprocal component according to claim 14 wherein the second ferrite substrate is formed from a hard material.

16. The method to form an integrated non-reciprocal component according to claim 15 wherein the hard material is barium-hexaferrite.

17. The method to form an integrated non-reciprocal component according to claim 14, further comprising:

forming a dielectric layer above the plurality of interlaced meander loops of metal line.

18. The method to form an integrated non-reciprocal component according to claim 17, further comprising:

forming a ground plane above the dielectric.

19. The method to form an integrated non-reciprocal component according to claim 17 wherein the dielectric layer is air.

* * * * *

UNITED STATES PATENT AND TRADEMARK OFFICE

CERTIFICATE OF CORRECTION

PATENT NO. : 7,936,230 B2
APPLICATION NO. : 12/498730
DATED : May 3, 2011
INVENTOR(S) : Rainer Pietig et al.

It is certified that error appears in the above-identified patent and that said Letters Patent is hereby corrected as shown below:

Column 8

Claim 17, Line 29, "component according to claim 14, further comprising:" should read as --component according to claim 8, further comprising:--.

Signed and Sealed this
Seventeenth Day of April, 2012

David J. Kappos

David J. Kappos
*Director of the United States Patent and Trademark Office*